US011293181B2

(12) United States Patent
Ma

(10) Patent No.: US 11,293,181 B2
(45) Date of Patent: Apr. 5, 2022

(54) 3D PRINTED AND COMBINED BUILDING WALLBOARD

(71) Applicant: Yingchuang Building Technique (Shanghai) Co., Ltd., Shanghai (CN)

(72) Inventor: Yihe Ma, Shanghai (CN)

(73) Assignee: Yingchuang Building Technique (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/475,368

(22) PCT Filed: Dec. 26, 2017

(86) PCT No.: PCT/CN2017/118685
§ 371 (c)(1),
(2) Date: Jul. 1, 2019

(87) PCT Pub. No.: WO2018/126951
PCT Pub. Date: Jul. 12, 2018

(65) Prior Publication Data

US 2019/0338518 A1 Nov. 7, 2019

(30) Foreign Application Priority Data

Jan. 3, 2017 (CN) ..... 201720001657.9

(51) Int. Cl.
*E04C 2/288* (2006.01)

(52) U.S. Cl.
CPC ..... *E04C 2/288* (2013.01)

(58) Field of Classification Search
CPC ..... E04C 2/00; E04C 2/06; E04C 2/288
See application file for complete search history.

(56) References Cited

U.S. PATENT DOCUMENTS 4,642,960 A * 2/1987 Wallover, III ..... E04B 2/8605 52/385

FOREIGN PATENT DOCUMENTS

CN 204738415 U * 11/2015
JP 2001294700 A * 10/2001

OTHER PUBLICATIONS

Machine Translation of CN 20473841U (Year: 2015).*
(Continued)

*Primary Examiner* — Sathavaram I Reddy
(74) *Attorney, Agent, or Firm* — WHGC, P.L.C.; John F. O'Rourke; Alexander R. Schlee

(57) ABSTRACT

3D Printed and Combined Building Wallboard (100, 200, 300) including external decorative plate (7), 3D printed external wallboard (1), cement concrete layer (9), 3D printed internal wallboard (2), internal decorative plate (8), and structural reinforcement component (10). Structural reinforcement (10) includes vertical steel reinforcements (5) and horizontal steel reinforcements (11) continuously bent in a convex-concave way along the lengthwise direction. The convex edge and the concave edge of each horizontal reinforcement (11) are respectively located in the wallboard of 3D printed external wallboard (1) and the wallboard of 3D printed internal wallboard (2). External decorative plate (7) is fixed on 3D printed external wallboard (1), internal decorative plate (8) is fixed on 3D printed internal wallboard (2), and the space between 3D printed external wallboard (1) and 3D printed internal wallboard (2) is filled with cement concrete layer (9). Thermal insulation (15) is provided between external wallboard (1) and concrete layer (9), and may be between internal plate (8) and internal wallboard (2).

7 Claims, 3 Drawing Sheets

(56) References Cited

OTHER PUBLICATIONS

Machine Translation of JP 2001-294700 (Year: 2001).*
Written Opinion of The International Searching Authority and Internation Search Report dated Mar. 29, 2018.

* cited by examiner

3D PRINTED AND COMBINED BUILDING WALLBOARD

CROSS-REFERENCE TO RELATED APPLICATION

This application claims the benefit of priority to China Patent Application No. 201720001657.9, filed Jan. 3, 2017, now China Utility Model Patent No. CN 206438674 U, granted Aug. 25, 2017, which contents are incorporated herein in its entirety.

BACKGROUND OF THE INVENTION

1. Technical Field

The present invention relates to a building component, in particular to a 3D printed and combined building wallboard.

2. Description of Related Art

A building wall has a load bearing function and an enclosing protection function. The load bearing function refers to a wall needing to have sufficient strength and stability. It should be noted here that, because a wall is a long, tall and thin component, ensuring stability is a very important technical indicator. Many walls, which reach the design requirements in strength calculation, are damaged due to insufficient stability. The enclosing protection function refers to thermo-technical requirements, sound insulation requirements, and landscaping requirements. The thermo-technical requirements refer to thermal management, heat preservation, and thermal insulation. They are not only related to the issue of building energy efficiency, but also affect the comfort requirements of users. The requirements of sound insulation refer to isolated sound transmission by air, and noise control. The landscaping requirements refer to the exterior decoration. Therefore, in the prior art, the construction of exterior walls, thermal insulation, and exterior wall decoration of most buildings is basically carried out step-by-step. The interior/exterior supporting frameworks are required for exterior wall construction and thermal insulation and exterior wall decoration requires scaffolding, which causes the defects of complex construction procedures, long construction period, and serious waste. Due to the lack of a building component integrating an external wall, thermal insulation, and exterior decoration, construction is in an inefficient state.

BRIEF SUMMARY OF THE INVENTION

The present invention is intended to provide a 3D printed and combined building wallboard, which obviates the disadvantages of the prior art. The present invention is implemented by 3D printed and combined building wallboard embodiments, which include an external decorative plate, a 3D printed external wallboard, a cement concrete layer, a 3D printed internal wallboard, an internal decorative plate, and a structural reinforcement component. The structural reinforcement component includes a plurality of vertical steel reinforcements, and a plurality of horizontal steel reinforcements continuously bent in a convex-concave way along the lengthwise direction. The horizontal steel reinforcements are evenly distributed with a preselected interval along the height of the wallboard, such a way that one is arranged in a forward way and another one is arranged in a reverse way. The convex edge and the concave edge of each horizontal steel reinforcement are respectively located in the wallboard of the 3D printed external wallboard and the wallboard of the 3D printed internal wallboard. The plurality of vertical steel reinforcements are located in the wallboard of the 3D printed external wallboard and the wallboard of the 3D printed internal wallboard and fixed at inner folding angles of the horizontal steel reinforcements. The external decorative plate is fixed on the 3D printed external wallboard, and the internal decorative plate is fixed on the 3D printed internal wallboard. The space between the 3D printed external wallboard and the 3D printed internal wallboard is filled with the cement concrete layer.

The horizontal steel reinforcements are evenly distributed in the form of a horizontal staggered arrangement in a way of one being arranged in a forward way and the other one being arranged in a reverse way, wherein the staggered arrangement adopts a spacing of one vertical steel reinforcement.

A thermal insulation layer is arranged between the external decorative plate and the 3D printed external wallboard. A thermal insulation layer is arranged between the 3D printed external wallboard and the cement concrete layer. A thermal insulation layer is arranged between the internal decorative plate and the 3D printed internal wallboard.

BRIEF DESCRIPTION OF THE DRAWINGS

Embodiments of the present invention disclosed herein are illustrated by way of example, and are not limited by the accompanying figures, in which like references indicate similar elements, and in which.

Skilled artisans can appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention. In the figures, like numbers correspond to like elements.

DETAILED DESCRIPTION OF THE INVENTION

Figure 1:
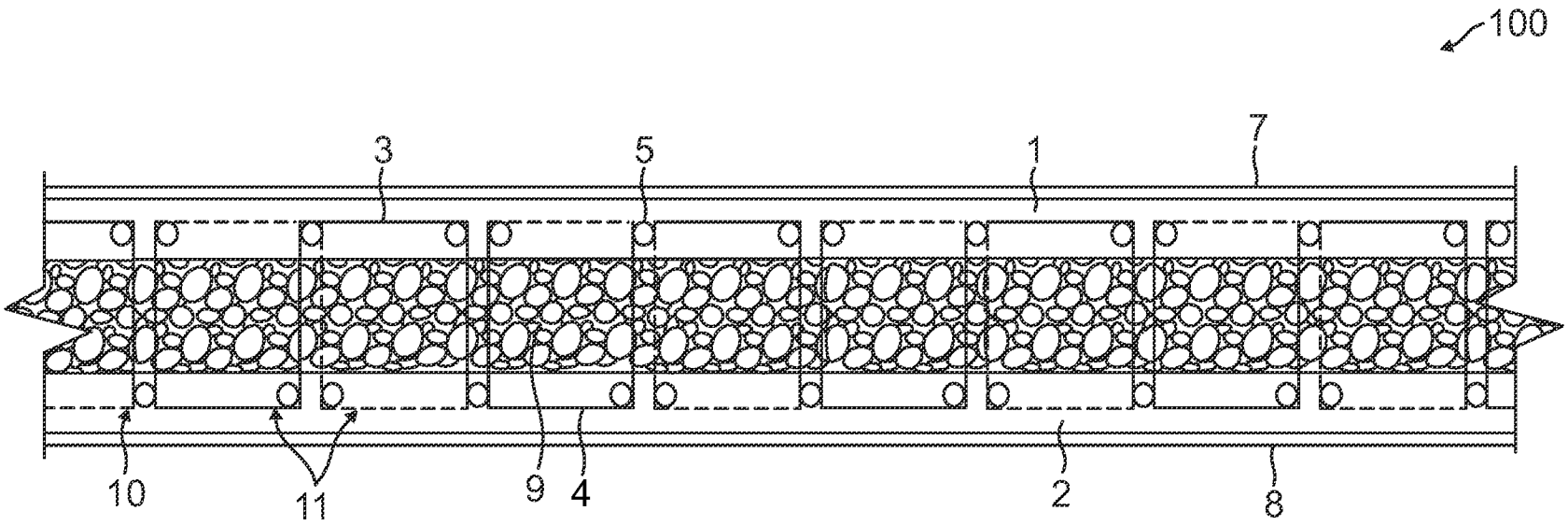
FIG. 1 is a horizontal-section structural schematic diagram of a first embodiment, in accordance with the teachings of the present invention.

The present invention will be further described below in connection with the following embodiments. FIG. 1 is a cross-section structural schematic diagram of a horizontal section of a first embodiment. FIG. 1 depicts a 3D printed and combined building wallboard 100, including external decorative plate 7, 3D printed external wallboard 1, cement concrete layer 9, 3D printed internal wallboard 2, internal decorative plate 8, and structural reinforcement component 10. Structural reinforcement component 10 includes a plurality of vertical steel reinforcements 5, and a plurality of horizontal steel reinforcements 11 continuously bent in a convex-concave way along the lengthwise direction of wallboard 100. In this embodiment, horizontal steel reinforcements 3 are arranged in a forward way, and horizontal steel reinforcements 4 are arranged in a reverse way. Horizontal steel reinforcements 3 and horizontal steel reinforcements 4 also are arranged in a staggered way with a preselected spacing of, for example and without limitation, one vertical steel reinforcement. Horizontal steel reinforcements 11 are evenly distributed with a preselected interval along the height of the wallboard in a way of one horizontal steel reinforcement 3 being arranged in a forward way and the other horizontal steel reinforcement 4 being arranged in a reverse way. The convex edge and the concave edge, of each horizontal steel reinforcement 3, 4, can be respectively located in the wallboard of the 3D printed external wallboard 1 and the wallboard of the 3D printed internal wallboard 2. Plurality of vertical steel reinforcements 5 can be located in the wallboard of the 3D printed external wallboard 1 and the wallboard of the 3D printed internal wallboard 2, and fixed at inner folding angles of horizontal steel reinforcements 11. External decorative plate 7 can be fixed on the 3D printed external wallboard 1. Internal decorative plate 8 can be fixed on the 3D printed internal wallboard 2. The space between the 3D printed external wallboard and the 3D printed internal wallboard is filled with the cement concrete layer 9.

Figure 2:
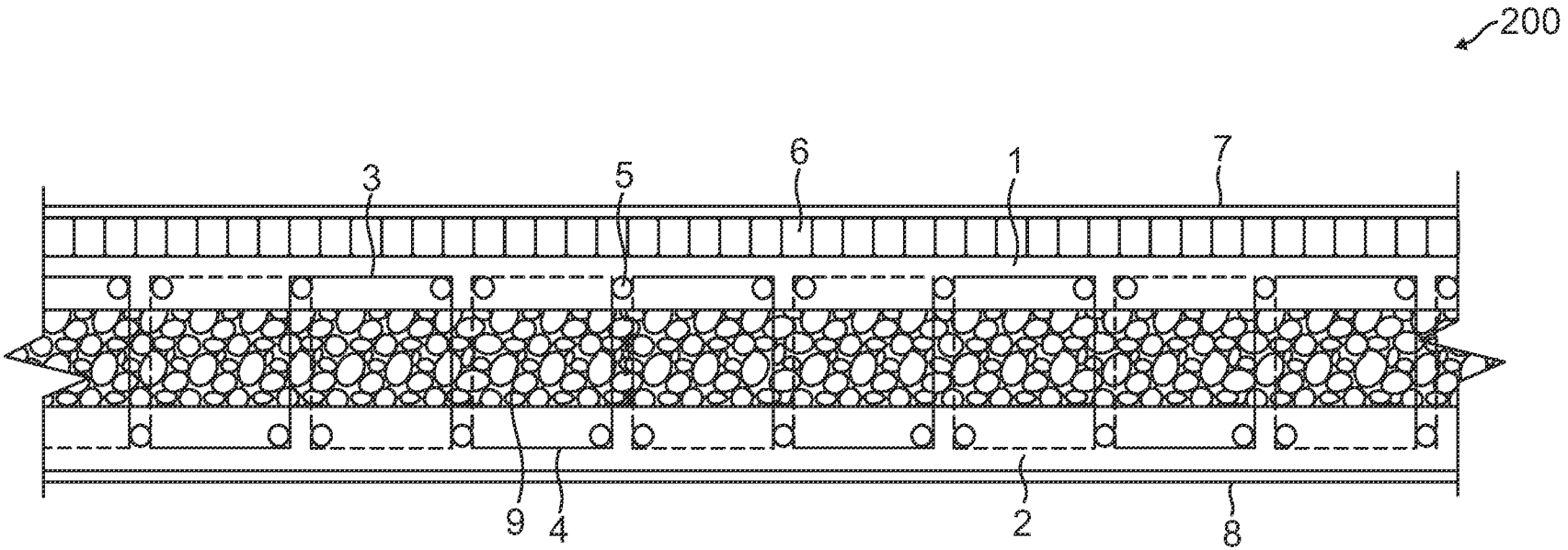
FIG. 2 is a horizontal-section structural schematic diagram of a second embodiment, in accordance with the teachings of the present invention.

FIG. 2 is a horizontal-section structural schematic diagram of a second embodiment of 3D printed and combined building wallboard 200. Wallboard 200 may contain elements described with respect to wallboard 100 of FIG. 1. However, a thermal insulation layer 6 can be arranged between the external decorative plate 7 and the 3D printed external wallboard 1.

Figure 3:
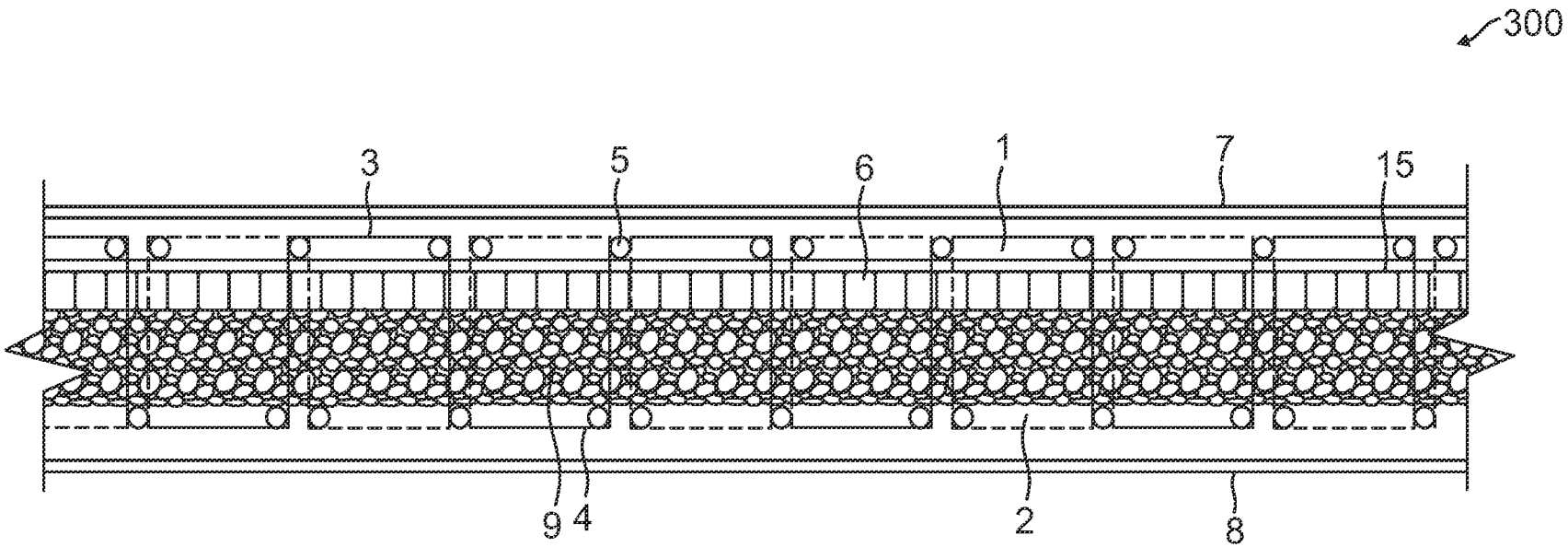
FIG. 3 is a horizontal-section structural schematic diagram of a third embodiment, in accordance with the teachings of the present invention.

FIG. 3 is a horizontal-section structural schematic diagram of a third embodiment of 3D printed and combined building wallboard 300. Wallboard 300 may contain elements described with respect to wallboard 200 of the embodiment of FIG. 2. However, a thermal insulation layer 15 may be arranged between the 3D printed external wallboard 1 and the cement concrete layer 9. Similarly, if a thermal insulation layer needs to be added to the internal wallboard 2, thermal insulation layer may be arranged in the same way as thermal insulation layer 15.

The present invention is described above with reference to the drawings and the embodiments, which are not intended to be limiting. Those skilled in the art can make adjustments according to the actual needs and various variants or modifications made within the scope of appended claims, which shall fall within the scope of protection.

INDUSTRIAL APPLICABILITY

The present invention has industrial applicability in the building/construction industry. An advantage is that any wallboard with a complicated structure can be printed through 3D printing technology, with thermal insulation layers and internal and external decorative layers also being constructed, in a standard plant, thus producing an integrated and modular wallboard, reducing construction components in a construction site, simplifying construction procedures, improving the working efficiency, saving time, material and labor and reducing the construction cost.

What is claimed is:

1. A 3D printed and combined building wallboard, comprising:

an external decorative plate;

a 3D printed external wallboard;

a 3D printed internal wallboard;

a cement concrete layer sandwiched between the 3D printed external wallboard and the 3D printed internal wallboard, said cement concrete layer filling a space extending between the 3D printed external wallboard and the 3D printed internal wallboard;

an internal decorative plate; and a structural reinforcement component, wherein the structural reinforcement component includes a plurality of vertical steel reinforcements and a plurality of horizontal steel reinforcements, said horizontal steel reinforcements as viewed in a horizontal cross-sectional view through the 3D printed and combined building wall being continuously bent in a meander shape extending with alternating convex- and inverted concave parts along the lengthwise direction through the entire cement concrete layer and into the 3D printed external and internal wallboards, wherein the plurality of horizontal steel reinforcements are evenly distributed at preselected vertical distance intervals along the height of the 3D printed and combined building wall with one being arranged in a forward way and another one being arranged in a reverse way, wherein a convex edge and a concave edge of each horizontal steel reinforcement are located in the 3D printed external wallboard and the 3D printed internal wallboard, respectively;

wherein the plurality of vertical steel reinforcements are located in the 3D printed external wallboard and the 3D printed internal wallboard and are fixed at inner folding angles of the plurality of horizontal steel reinforcements;

wherein the external decorative plate is fixed on the 3D printed external wallboard, and the internal decorative plate is fixed on the 3D printed internal wallboard.

2. The 3D printed and combined building wallboard according to claim 1, wherein the plurality of horizontal steel reinforcements are evenly distributed in the form of a horizontal staggered arrangement in a way of one horizontal steel reinforcement being arranged in a forward way and another horizontal steel reinforcement being arranged in a reverse way, and wherein the horizontal staggered arrangement adopts a spacing of one vertical steel reinforcement.

3. The 3D printed and combined building wall according to claim 1, wherein a thermal insulation layer is arranged between the external decorative plate and the 3D printed external wallboard.

4. The 3D printed and combined building wall according to claim 2, wherein a thermal insulation layer is arranged between the external decorative plate and the 3D printed external wallboard.

5. The 3D printed and combined building wall according to claim 1, wherein a thermal insulation layer is arranged between the 3D printed external wallboard and the cement concrete layer.

6. The 3D printed and combined building wall according to claim 1, wherein a thermal insulation layer is arranged between the internal decorative plate and the 3D printed internal wallboard.

7. The 3D printed and combined building wall according to claim 2, wherein a thermal insulation layer is arranged between the internal decorative plate and the 3D printed internal wallboard.

* * * * *